US007571506B2

(12) United States Patent
Poehler

(10) Patent No.: US 7,571,506 B2
(45) Date of Patent: Aug. 11, 2009

(54) FRONT-LOADING TYPE WASHING MACHINE

(75) Inventor: Reinhold Poehler, Adelberg (DE)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 11/856,876

(22) Filed: Sep. 18, 2007

(65) Prior Publication Data

US 2008/0037020 A1 Feb. 14, 2008

Related U.S. Application Data

(62) Division of application No. 10/890,590, filed on Jul. 14, 2004, now Pat. No. 7,401,480.

(30) Foreign Application Priority Data

Jul. 23, 2003 (EP) ..... 03102270

(51) Int. Cl.
*D06F 33/02* (2006.01)

(52) U.S. Cl. ..... 8/158; 68/12.02; 68/12.27

(58) Field of Classification Search ..... 8/158
See application file for complete search history.

(56) References Cited

U.S. PATENT DOCUMENTS 2,960,780 A 11/1960 Stilwell, Jr.
3,276,229 A * 10/1966 Deiss ..... 68/139
3,300,869 A * 1/1967 Bergeson et al. ..... 34/527
3,841,117 A * 10/1974 Crivilles ..... 68/20
5,289,703 A 3/1994 Hiyashi et al.
2003/0019253 A1 1/2003 Lorenz et al.
2005/0102766 A1* 5/2005 Vande Haar et al. ..... 8/159

FOREIGN PATENT DOCUMENTS

DE 29610968 9/1996
DE 29820605 3/2000
DE 19961459 A1 7/2001
JP 2001224890 8/2001
JP 2001224890 A * 8/2001

* cited by examiner

*Primary Examiner*—Michael Barr
*Assistant Examiner*—Jason P Riggleman
(74) *Attorney, Agent, or Firm*—Clifton Green McGarry Bair PC

(57) ABSTRACT

A method of detecting an item of clothing in the space between a door assembly of a washing machine and an annular gasket interposed between the door assembly and a washing tub of the washing machine. The method further includes taking an action to remove the item of the laundry from the space between the door assembly and the annular gasket.

9 Claims, 2 Drawing Sheets

FRONT-LOADING TYPE WASHING MACHINE

CROSS REFERENCE TO RELATED APPLICATIONS

This application is a division of U.S. patent application Ser. No. 10/890,590, filed Jul. 14, 2004, the entirety of which is incorporated herein by reference.

BACKGROUND OF THE INVENTION

1. Field of the Invention

The present invention relates to a clothes washing machine of the drum type. The invention relates particularly to a washing machine of the front-loading type comprising a control unit, a washing tub, a drum which is rotatable within said washing tub and capable of containing the items of laundry to be washed, a door assembly for closing the tub and an annular bellow-type gasket interposed between the door assembly and the washing tub.

In the above type of washing machines with a horizontal or near-horizontal drum axis, there is a danger both during washing and during spin-drying that an item of laundry can partially extend beyond the drum opening in a zone between the door, particularly its domed central wall member of glass and of circular shape, and the bellow-type gasket or a portion thereof, so that this item can become caught between such gasket and the glass door.

If this takes place during the washing process, the friction that occurs, as the drum rotates, between the item of laundry and the door gasket will have an adverse effect such that it may result in the transfer of any detergent residues and/or sludge deposits present on the gasket to the item of laundry. Moreover, since this item of laundry has been withdrawn from the washing process, this may result in the gasket and piece of laundry sustaining wear and tear owing to friction.

If this should occur during spin-drying, the piece of laundry in question will inevitably be damaged, i.e. the fabric will be mechanically destroyed and the gasket seal will also sustain considerable wear and tear.

2. Description of the Related Art

The current state of the art, particularly in washing machines with high-speed spin-drying functions, involves the application of a laundry guard or diverter, which is designed to divert the piece of laundry inside the machine back to the drum. The current state of the art does not frequently achieve this, or does not do so adequately, for some items of laundry (i.e. socks and the like) as well as for large quantities of laundry.

In this case the laundry guard or diverter causes extra damage to the laundry since at a high number of revolutions per minute, it bounces against the laundry guard at high speed instead of sliding onto the gasket surface.

It would thus be desirable, and this is the aim of the present invention, to provide a clothes washing machine having a system capable of avoiding the above-mentioned disadvantages and to avoid this kind of damage to the laundry in a very reliably way.

SUMMARY OF THE INVENTION

According to the present invention, there is provided a clothes washing machine provided with sensor means placed in the zone of the annular gasket extending beyond the rim of the drum and adapted to detect when at least one item of laundry is present in the zone, in order to provide the central unit with a signal indicative of a working condition which may be harmful for the items to be washed.

According to a first embodiment of the invention, a sensor is used which detects the mechanical and/or dynamic effect of the drum rotation, with respect to the projecting piece of laundry on a laundry guard, integral with the door gasket.

According to a second embodiment of the invention, it may also be advantageous to apply an optical sensor, i.e. a photoelectric barrier between, e.g., the door gasket and the glass door and/or to apply a photosensor which is, e.g., mounted in the door gasket in such a way that projecting pieces of laundry pass over it. Conversely, it is possible to position a photosensor, e.g., in the glass door, which can distinguish between the gasket surface and a piece of laundry.

According to a third embodiment of the invention, it is possible to identify items of laundry extending out of the drum by means of electrical resistance measurement. According to this embodiment, the moist laundry sliding over the electrically conductive contacts provided in the gasket, while the drum is rotating, leads to a change in resistance and therefore to a related signal to the control unit of the washing machine.

In all the above embodiments, when the "working" condition is detected, it is possible to reverse the drum rotation correspondingly, which should change the distribution of the laundry in such a way that the piece of laundry projecting over the rim of the drum is repositioned inside the drum again. The cycle of the washing machine can be modified in other ways so that the laundry that is projecting beyond the rim of the drum is transported back into the drum by means of a predetermined reverse phase. This reverse phase will be active only until the piece of laundry is positioned back inside the drum. This reverse phase is also time-limited and after a predetermined number of unsuccessful attempts, the following wash—rinse—spin-dry sequence of the washing machine is changed accordingly so that, e.g., the programmed spin-drying rotation speed is reduced to a predetermined level in accordance with this potentially harmful situation (in order to avoid possible damages to laundry). In this case the user receives the appropriate information at that moment and/or at the end of a washing cycle by a display or similar means.

BRIEF DESCRIPTION OF THE DRAWINGS

The invention will be better appreciated from the following description given solely by way of non-limiting example and with reference to the accompanying drawings in which.

DETAILED DESCRIPTION

Figure 1:
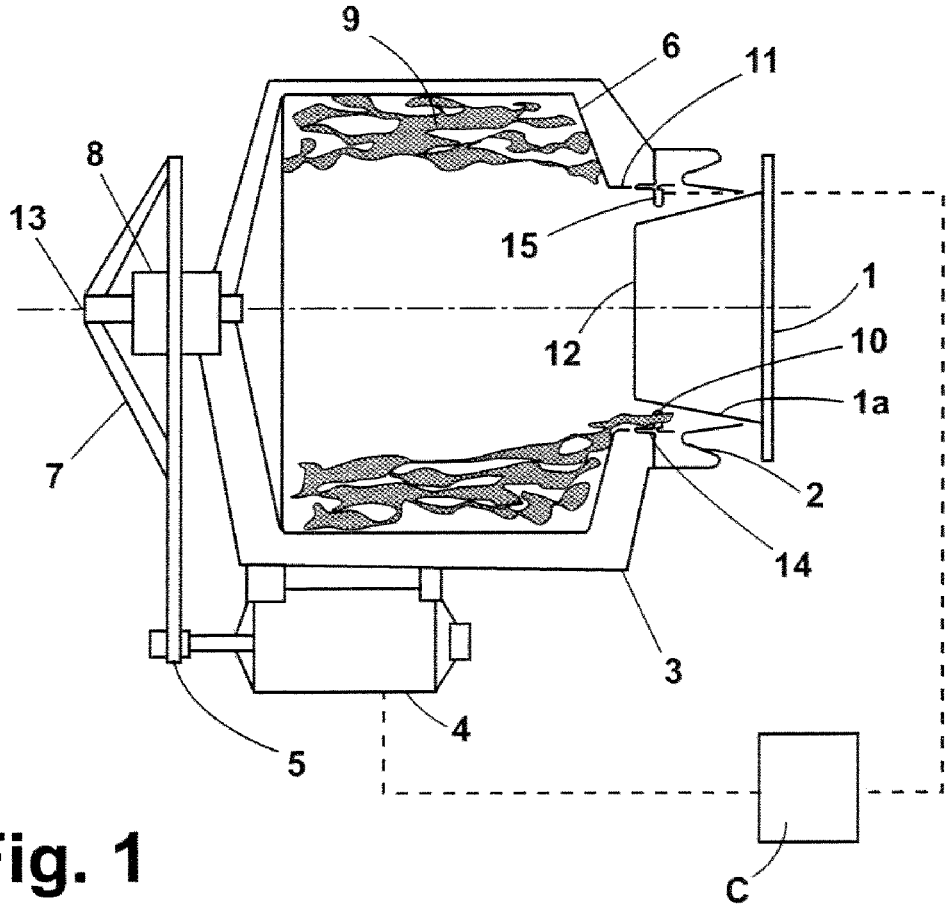
FIG. 1 is a schematic cross-section of a washing machine in which a dangerous condition for laundry is present.

With reference to FIG. 1, a washing machine comprises a tub 3, a washing drum 6 with its rotational axis 13 and a drum opening 11.

The drive mechanism may comprise at least a pulley 7 and a drive belt 5, a drum bearing 8 and a drive motor 4. The motor 4 (as other not shown electrical components of the washing machine) is connected to a control unit C (FIG. 1) of the washing machine.

A door 1 presents a bottom flat panel 12 and a conical side portion 1*a*. The door is provided with a bellow-type gasket 2 with a T-shaped lip 14 and a laundry guard 15. The gasket 12 is mounted on the front opening of the tub 3, and it is in contact, in the closed position of the door 1, with the conical portion 1*a* thereof.

The laundry 9 is distributed around the internal circumferential surface of the drum 6 and a laundry item 10 is shown which projects out of the drum 6 between the bottom panel 12 of the glass door and the T-shaped lip 14 via the drum opening 11. As said above, this condition has the potential to be harmful for the item 10 of laundry.

According to a first embodiment of the invention (FIGS. 2, 3) a pressure sensor 22 is integrated into the laundry guard 15 mounted on a T-shaped lip 20 of the gasket 2. The assembly of FIGS. 2 and 3 comprises a pressure sensor 22 installed on an abutment 24 and having a mobile contact button 26. With the arrow 28 it is indicated the direction of movement of the laundry projecting from the drum. With the reference 29 the impact wall of the laundry guard 15 is indicated.

Figure 2:
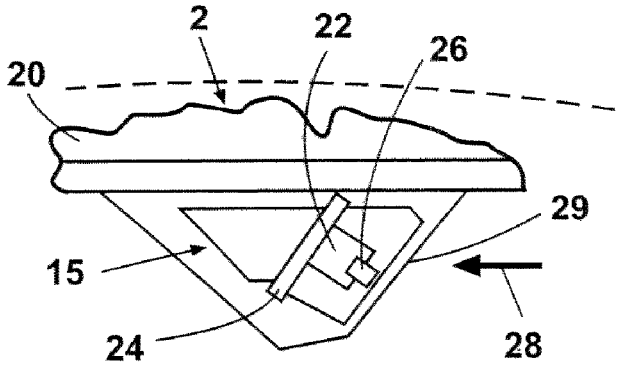
FIG. 2 is a schematic cross-section of an electromechanical sensor integrated into the laundry guard of the machine shown in FIG. 1.
Figure 3:
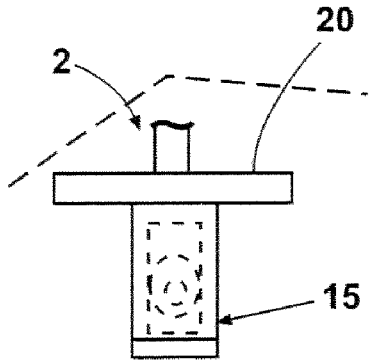
FIG. 3 is a front view of the laundry guard of FIG. 2.

The mechanical switch shown in FIGS. 2 and 3 can be replaced by other measuring devices, e.g., by an acceleration sensor. The pressure-sensor abutment 24 can be fitted with a strain gauge as well as with a polycrystalline piezo foil.

Figure 4:
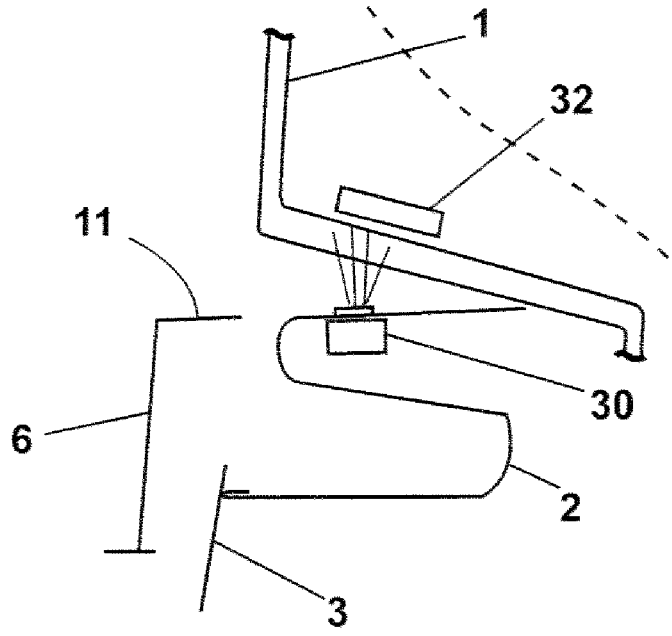
FIG. 4 is a schematic view of an optical sensor according to the present invention.

According to a second embodiment of the invention (FIG. 4), an optical detection of the laundry projecting from the drum can be carried out. The sensor of FIG. 4 presents an optical sensor comprising a first component 30 (light source) positioned in the gasket 2 and a second component 32 (light detector) positioned in the door 1.

The laundry projecting over the rim 11 of the drum 6 is detected by the laundry absorbing the light transmitted by light source 30, light detector 32 detecting this interruption, or vice versa.

It is also possible to use only a luminance sensor in one of the positions and to detect the change in luminance as the result of the projecting laundry.

Figure 5:
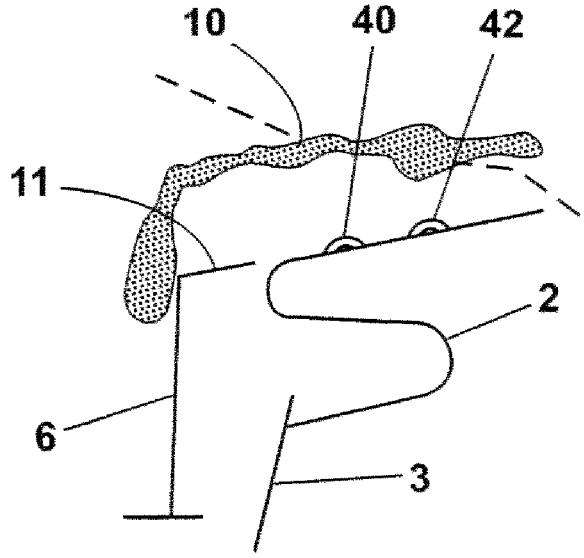
FIG. 5 is a schematic view of an electrical sensor according to the present invention.

According to a third embodiment (FIG. 5), in order to identify items of laundry extending out of the drum an electrical resistance measurement (axial arrangement) is carried out.

According to such embodiment, two electrically conductive contacts 40 and 42 are integrated into the gasket 2. When an item of laundry 10 extends beyond the rim 11 of the drum 6, it bridges the two electrically conductive contacts 40 and 42. The moist laundry sliding over such electrically conductive contacts, while the drum is rotating, leads to a change in resistance and therefore provide the control unit C of the machine with a related signal.

Other kind of sensors can be used according to the present invention, for instance sensors for determining the mechanical/dynamic effect of the piece of laundry on the door gasket and/or parts thereof, or acoustic measuring devices.

What is claimed is:

1. A method of detecting an item of clothing in a washing machine having a drum, a washing tub, a door moveable between an open and closed position for selectively closing the washing tub and having an exterior surface located exteriorly of the drum, an interior surface axially spaced inwardly from the exterior surface in the closed position, and a peripheral surface extending between the exterior and interior surfaces, an annular gasket interposed between the door and the washing tub, a zone defined by a space between the annular gasket and the peripheral surface when the door is in the closed position, and a control system, the method comprising the steps of:

rotating the drum;

detecting an item of laundry present in the zone by a sensing device;

providing the control unit with a signal, from the sensing device, indicating the presence of the item of laundry; and taking an action in response to the control unit signal to remove the item of laundry from the zone.

2. The method of claim 1, wherein the action comprises rotating the drum in a reverse direction.

3. The method of claim 2, wherein the step of rotating the drum in a reverse direction continues until at least one of the following occurs: the item of laundry returns to the drum or a pre-determined period of time elapses.

4. The method of claim 3, wherein when a pre-determined period of time elapses, the rotational speed of the drum is reduced.

5. The method of claim 4, further comprising the step of indicating the presence of an item of laundry in the zone on a user interface.

6. The method of claim 1, wherein the step of detecting an item of laundry present in the zone includes measuring a change in pressure when an item of laundry is present.

7. The method of claim 1, wherein the step of detecting an item of laundry present in the zone includes detecting an interruption in a beam of light when an item of laundry is present.

8. The method of claim 1, wherein the step of detecting an item of laundry present in the zone includes measuring a change in resistance between electrodes when an item of laundry is present.

9. The method of claim 1, wherein the action continues until at least one of the following occurs: the item of laundry returns to the drum or a pre-determined period of time elapses.

* * * * *